US007407407B2

(12) United States Patent
Oesterhaus et al.

(10) Patent No.: US 7,407,407 B2
(45) Date of Patent: Aug. 5, 2008

(54) TAP-OFF CONNECTING ARRANGEMENT FOR MULTI-CONDUCTOR CABLES

(75) Inventors: Jens Oesterhaus, Detmold (DE); Joerg Buschkamp, Detmold (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 12/001,383

(22) Filed: Dec. 11, 2007

(65) Prior Publication Data

US 2008/0153346 A1 Jun. 26, 2008

(30) Foreign Application Priority Data

Dec. 21, 2006 (DE) ..... 20 2006 019 520 U

(51) Int. Cl.
*H01R 4/24* (2006.01)

(52) U.S. Cl. ..... 439/404; 439/499; 439/403; 439/405

(58) Field of Classification Search ..... 439/329, 439/403–405, 422, 499
See application file for complete search history.

(56) References Cited

U.S. PATENT DOCUMENTS

| | | | | |
|---|---|---|---|---|
| 4,252,396 | A | 2/1981 | Wilson | |
| 4,406,511 | A | 9/1983 | Hayes | |
| 5,009,612 | A * | 4/1991 | Rishworth et al. | 439/403 |
| 5,076,801 | A | 12/1991 | Schroll | |
| 5,338,220 | A * | 8/1994 | Soes et al. | 439/403 |
| 5,429,526 | A | 7/1995 | Ann | |
| 6,666,706 | B1 * | 12/2003 | Jones et al. | 439/405 |
| 7,234,961 | B2 | 6/2007 | Arlitt | |

FOREIGN PATENT DOCUMENTS

| | | |
|---|---|---|
| DE | 34 22 607 A1 | 12/1984 |
| DE | 92 10 333.2 | 11/1992 |
| DE | 44 36 829 A1 | 4/1996 |
| EP | 1 518 812 B1 | 11/2006 |

* cited by examiner

*Primary Examiner*—Tho D Ta
(74) *Attorney, Agent, or Firm*—Lawrence E Laubscher, Sr.; Lawrence E Laubscher, Jr.

(57) ABSTRACT

A connector arrangement for connecting the insulated conductors of a flat cable with an output load includes insulation-piercing contacts that extend upwardly from the horizontal upper surface of the rectangular base member of a connector housing. When a housing cover member is slidably displaced longitudinally of the base member from a first position toward a second position, a first wedge arrangement displaces an actuator plate and a cable support plate downwardly to force the cable into insulation-piercing engagement with the contacts. A locator insulating lug normally extends upwardly from the cable support plate for insertion within an access opening contained in the cable, and between the separated ends defined by an intermediate portion of a conductor that is separated by the access opening. When the cable is uniform and contains no access opening, the lug is displaced by the cable toward an inoperable position relative to the support plate.

20 Claims, 14 Drawing Sheets

TAP-OFF CONNECTING ARRANGEMENT FOR MULTI-CONDUCTOR CABLES

CROSS REFERENCE TO RELATED APPLICATIONS

This application is a companion application to the prior Oesterhaus et al application Ser. No. 11/799,210 filed May 1, 2007, entitled "Connector Arrangement for Multi-Conductor Cables."

BACKGROUND OF THE INVENTION

1. Field of the Invention

A connector arrangement for connecting the insulated conductors of a flat cable with a plurality of tap-off branch conductors includes a plurality of insulation-piercing contacts that extend upwardly from the horizontal upper surface of the rectangular base member of a connector housing. When a housing cover member is slidably displaced longitudinally of the base member from a first position toward a second position, a first wedge arrangement displaces an actuator plate and a cable support plate downwardly to force the cable into insulation-piercing engagement with the contacts. A locator insulating lug normally extends upwardly from the cable support plate for insertion within an access opening contained in the cable. When the cable is uniform and contains no access opening, the lug is displaced by the cable toward an inoperable position relative to the support plate.

2. Description of Related Art

It is well known in the patented prior art to provide connector arrangements with insulation piercing contacts, as shown by the U.S. patent to Jaschke et al U.S. Pat. No. 6,976,866, the German Gebrauchsmuster No. G 92 10 333.2, and the German patent No. DE 44 36 829. Various types of connectors for flat cables have been proposed, as shown by the U.S. patents to Wilson U.S. Pat. No. 4,252,396, Schroll U.S. Pat. No. 5,076,801, and Ann U.S. Pat. No. 5,429,526. Nevertheless, there is a need for further development, particularly also with regard to the fast and secure wiring of flat cables with relatively many conductors.

As shown by the German patent No. DE 34 22 607 C1, the connector device can be so shaped that it can be so shaped that it can be placed only upon the flat cable when a wire beforehand was interrupted at the place of attachment and displays a rupture in that area. Lugs on one of the parts of the connector device engage the interrupted area of this wire. This serves to orient the position of the connection device and ensures that it can be assembled only when corresponding ruptures are provided. In addition, the lug separates and insulates the two ends of the interrupted conductor from each other.

This solution proved effective, particularly when employed in tight building shafts because it can be handled in a simple manner.

In the European patent No. EP 1 518 812 B1, a similar solution is proposed wherein a connector device according to the German patent No. DE 34 22 607 C2 is designed for use in elevator shafts where, for example, the safety circuit must be interrupted in a specific location.

There is a disadvantage to both of these solutions in the state of the art. The connection device can be used only when a flat cable must also really be provided with ruptures so that, for use on a flat cable without rupture in the conductor, one must readily keep an additional connection device without the lugs.

The present invention was developed to provide a connector device which can be assembled either on flat-band cables that are uniform and continuous, or flat-band cables that contain penetrations or ruptures in one or more of the insulated conductors, wherein means are provided that ensure a separation and insulation of the two ends of the interruption conductor.

SUMMARY OF THE INVENTION

Accordingly, a primary object of the present invention is to provide a flat cable connector arrangement including a cable support member provided with an insulating locator lug that normally extends upwardly from the cable support plate for insertion within an access opening contained in the adjacent face of the cable and between the severed ends of an intermediate portion of an insulated conductor, which locator lug is displaced toward an inoperative position relative to the cable support plate when the cable is uniform and does not contain any access opening.

According to a first embodiment of the invention, the locator lug is mounted on an integral flap portion of the cable support member that is bent outwardly by the engagement between the uniform cable and the locator lug. The flap portion is defined in the cable support plate by a line of fracture, or by a through cut. In a second embodiment, the cable support plate contains a line of fracture such that the lug is completely separated from the cable support member upon engagement between the lug and the uniform cable. In a third embodiment, a resilient compressible locator lug is deformed by the uniform cable toward an inoperable position relative to the cable support member.

A further object of the invention is to provide a cable support plate that carries the insulating locator lugs and is guided for vertical displacement between upper and lower positions relative to the base member, said support plate in its upper position being operable to support the cable with the insulated conductors positioned above and spaced from the corresponding insulation-piercing contacts. When the cover member is operated horizontally, first wedge means displace the actuator plate, the flat cable, and the cable support plate downwardly to effect piercing of the insulation and electrical engagement with the associated conductor. Catch means are provided for locking the cable support plate in its lower position.

In this manner, of course, one renounces the safety aspect, i.e., making sure that a flat cable, if it is to contain an access opening, was really provided with this opening because an assembly is also possible on a cable that was not provided with the opening. But doing without this automatic safety aspect is countered by the possibility of making multiple use of the arrangement in individual cases on flat cables without and without access openings. In case access openings are provided, separation and insulation between the two ends of the interrupted conductor is provided by the insulating locator lug.

In a preferred manner, the housing has a multipart structure and displays a base member and a cover member, which again are made in a multipart manner. It is possible to design all parts of the base and cover members essentially in the planar plate-like form so that the entire housing will have a relatively flat structure.

Preferably, there is provided here a sliding cover member that is movably guided on a base member and that, on its lower surface, carries wedges that cooperate with wedges of an actuator plate, whereby the actuator plate with the cable and a cable support plate as a unit are pressed downwardly as a unit upon the insulation-penetrating contacts. This embodiment is compact and nevertheless makes for particularly sure wiring.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
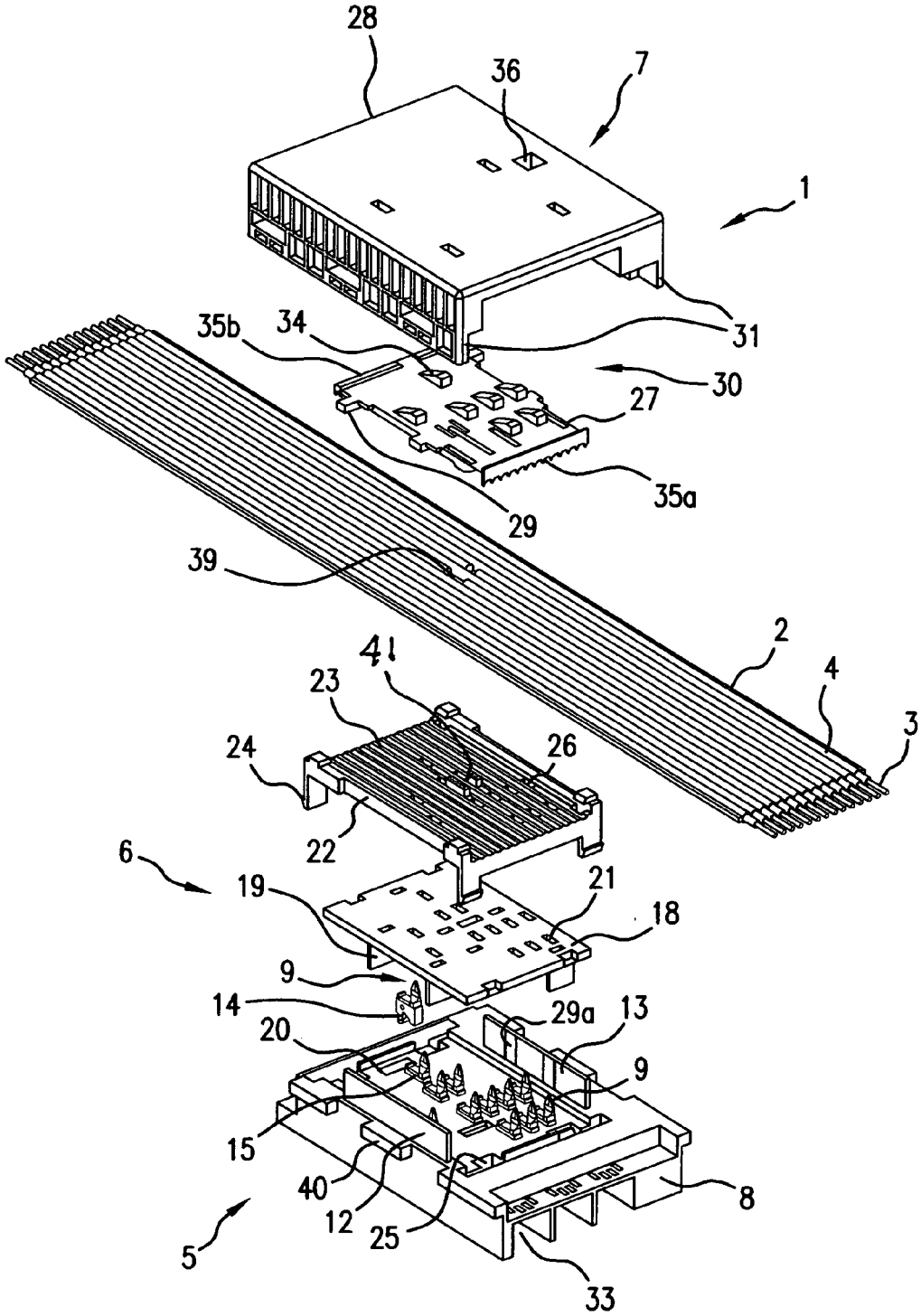
FIG. 1 is an exploded perspective view of the flat cable insulation-piercing connector arrangement of the present invention.

Referring first more particularly to FIG. 1, the connector arrangement 1 of the present invention is adapted for use with a flat cable 2 having a plurality of insulated conductors 3 that are enclosed in an insulating outer cable sheath 4. The connector arrangement includes housing means 5 having base means 6 for supporting the flat cable 2, and top cover means 7 for enclosing the area above the cable 2.

Figure 5A:
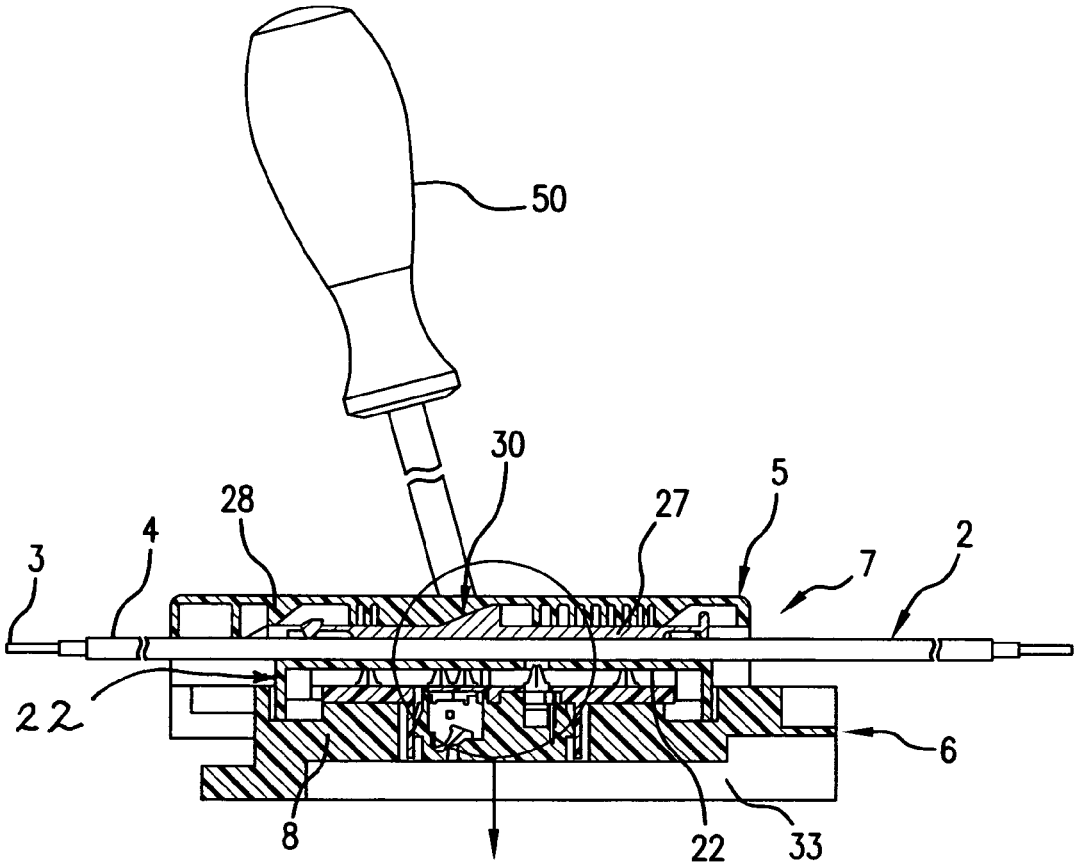
FIGS. 5*a* and 5*b*; 6*a* and 6*b*; and 7*a*, 7*b* and 7*c* are longitudinal sectional and detailed views of the connector arrangement with the cover member in the initial, intermediate and final positions relative to the housing base member, respectively.
Figure 5B:
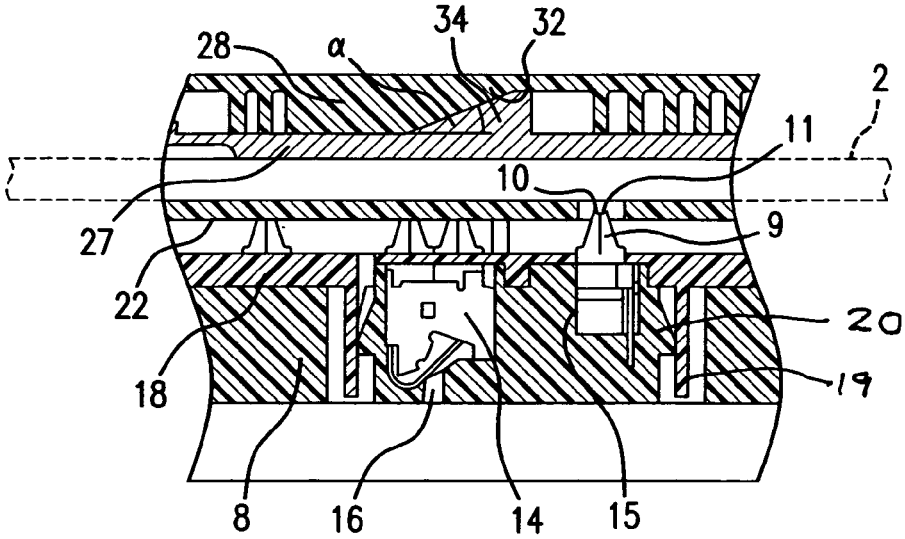

The base means 6 includes a generally rectangular base member 8 formed from electrically-insulating synthetic plastic material and having a horizontal upper surface in which are mounted a plurality of upwardly-extending electrical contacts 9 that terminate at their upper extremities in knife edges 10 and 11 (FIG. 5*b*). The contacts are stabilized by a stabilizing plate 18 that contains a plurality of slits 21 through which the contacts 9 extend. The contact stabilizing plate is fastened to the base member 8 by downwardly extending first catch means 19 that engage corresponding catch means 20 on the base member. Mounted above the contact stabilizing plate 18 is a horizontal support member 22 having a contoured upper surface 23 that corresponds with the adjacent surface of the flat cable 2. The cable support member 22 is fastened to the base member 8 by means of downwardly extending guide legs 24 having catch feet 24*a* that engage in corresponding catch openings 25 provided in the base member 8. The cable support plate 22 supports the flat cable 2 longitudinally of the base member 8, said support plate containing a plurality of slits 26 that respectively receive the contacts 9 when the cable support plate is in its lower position.

Arranged above the flat cable 2 is an actuator plate 27 having laterally extending guide tabs 29 that extend within corresponding guide grooves 29*a* contained in the adjacent surfaces of the housing centering walls 12 and 13. The cover means 7 includes a cover member 28 that is connected for longitudinal sliding movement relative to the housing base member 8. First wedge means 30 (FIG. 5*a*) are provided between the actuator plate 27 and the lower surface of the cover member 28, which wedge means serve to force the flat cable 2 downwardly together with the cable support member 22 toward the contacts 9 that are supported by the base member 8, whereupon the knife edges 10 and 11 of the insulation-piercing contacts 9 sever the insulation layers of the respective associated conductors to electrically engage the conductor contained therein. The first wedge means 30 include wedge members 34 (FIG. 5*b*) carried by the upper surface of the actuator plate 27 for cooperation with corresponding wedge members 32 carried by the lower surface of the cover member 28.

Figure 2:
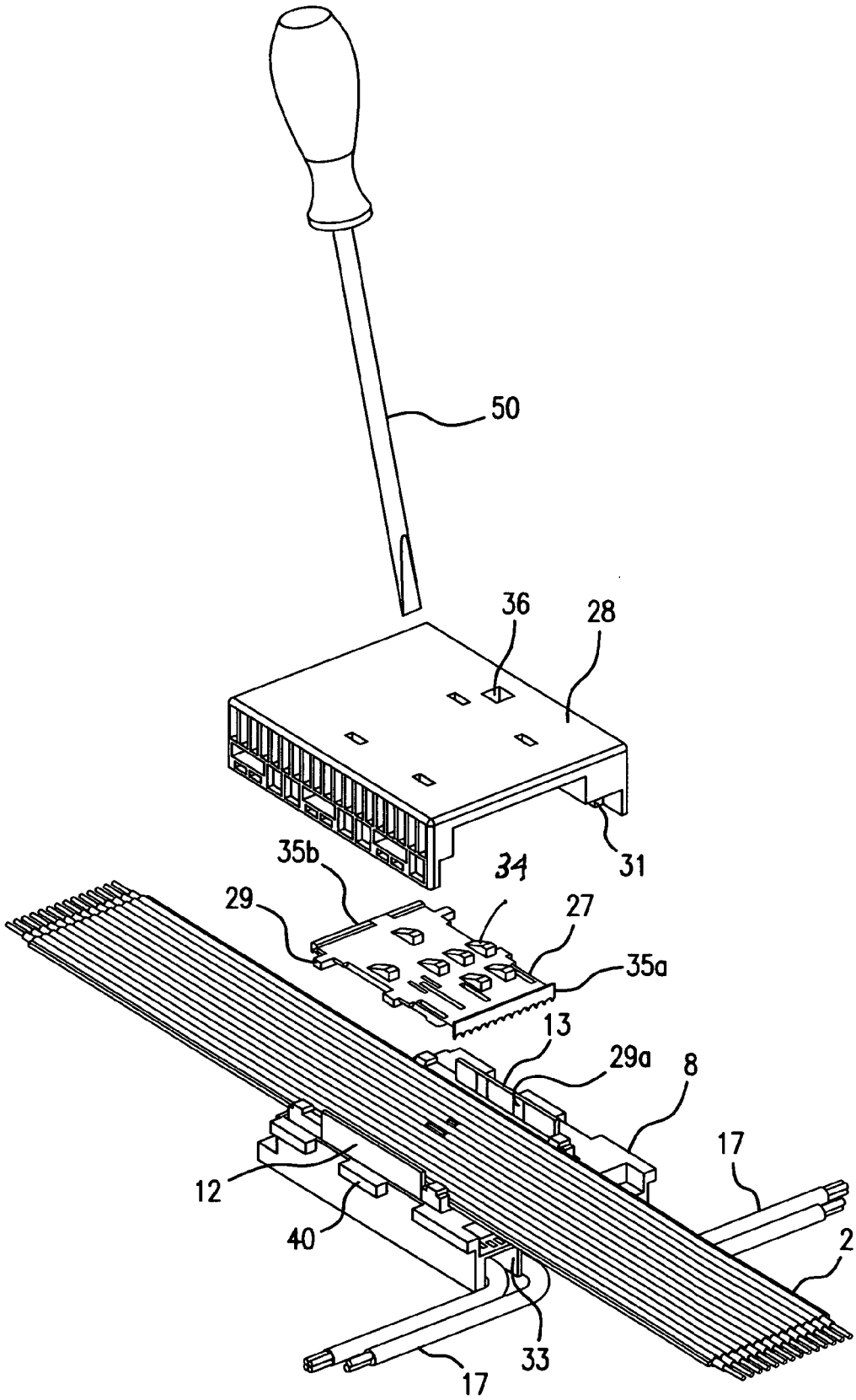
FIG. 2 is a partially exploded view illustrating an initial preparatory step for operating the connector device.
Figure 3:
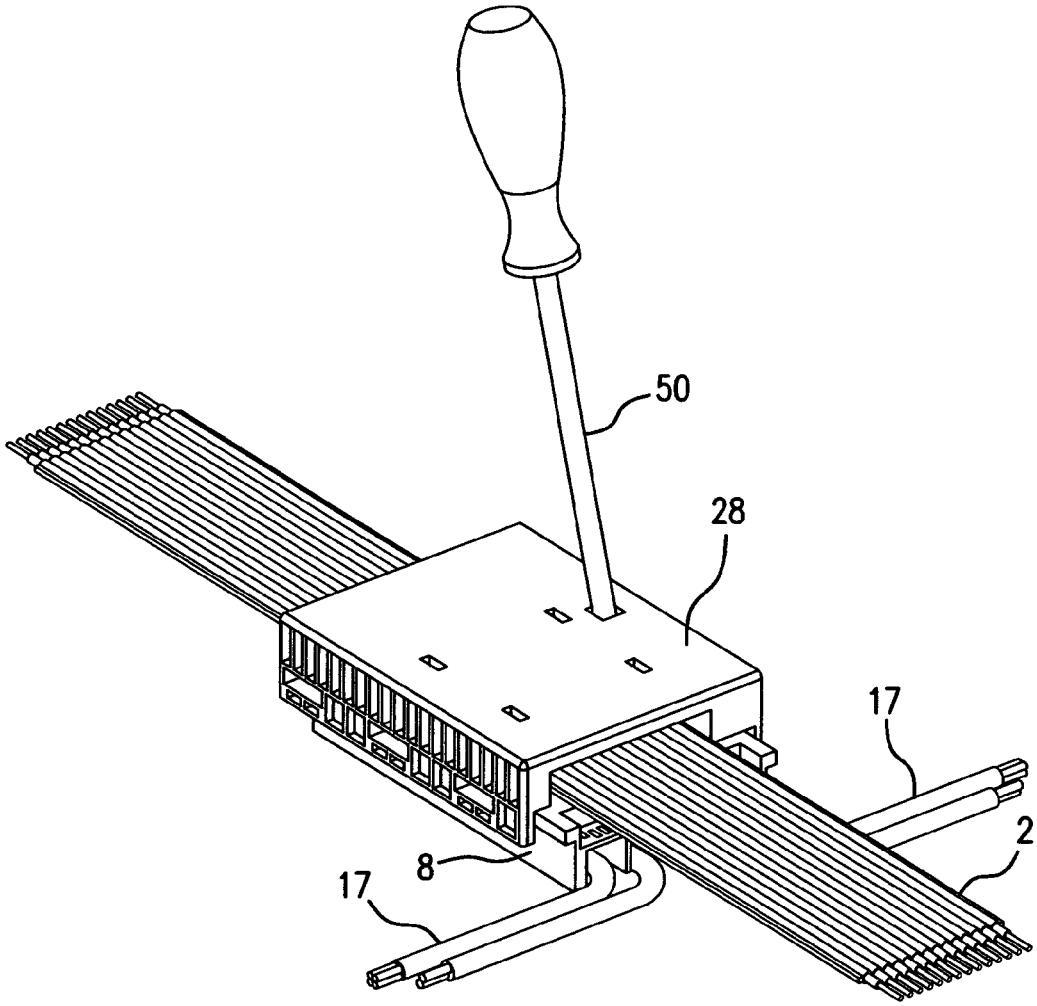
FIGS. 3 and 4 are perspective views illustrating the connector arrangement when in initial and intermediate conditions of operation, respectively.
Figure 4:
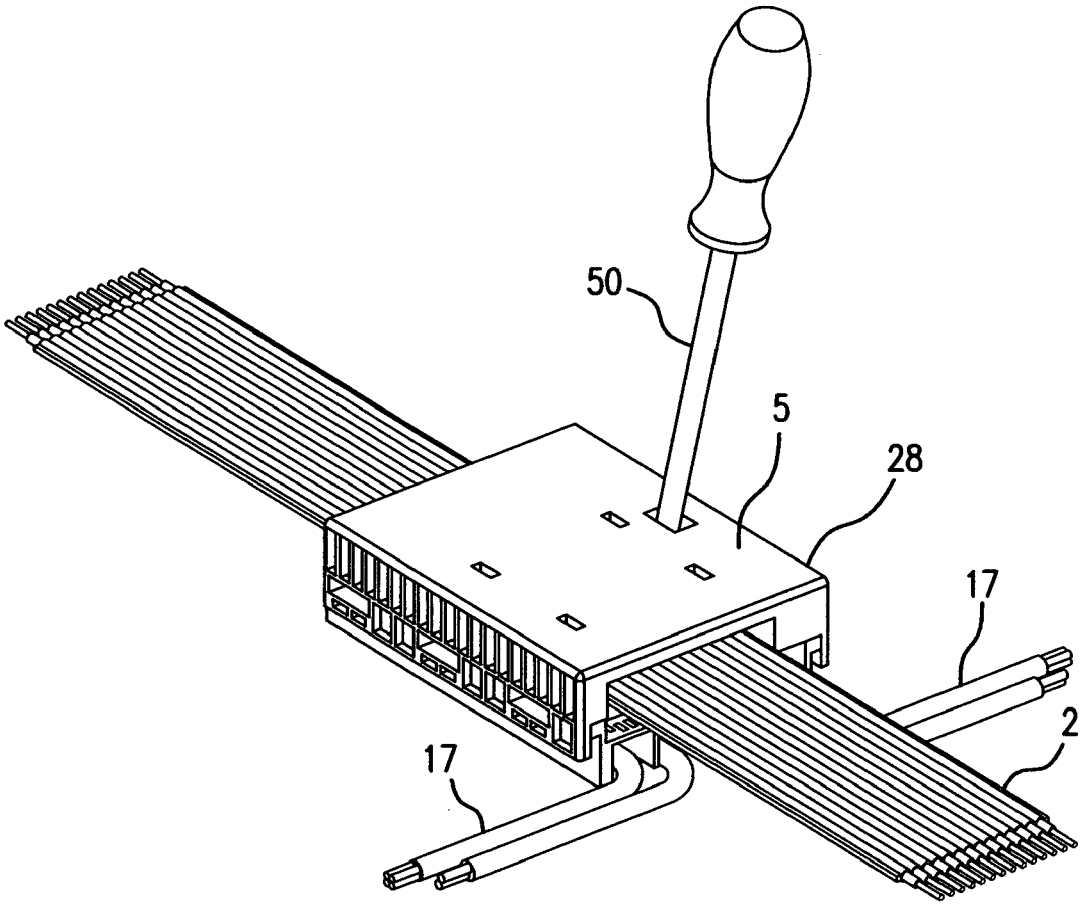

Referring now to FIG. 2, it will be seen that tap-off branch conductors 17 extend from channels 33 contained in the bottom surface of the base member 8. At one end the tap-off branch conductors 17 are connected with the corresponding insulation-piercing contacts 9 via openings 16 (FIG. 1*b*) and resilient contact means 14 mounted in chambers 15, and the other ends of the branch conductors are connected with associated electrical equipment, not shown. During the assembly of the connector arrangement, the flat cable 2 is inserted longitudinally between the centering walls 12 and 13 of the base member 8, whereupon the actuating plate 27 is downwardly displaced in seated arrangement on the flat cable 2, as guided by the cooperation between the lateral guide tabs 29 on the actuator plate and the corresponding guide grooves 29*a* contained in the centering side walls. The cover member 28 is longitudinally slidably connected with one end of the base member 8 by inwardly directed guide rails 31 (FIG. 8) on the lower ends of the side walls of the cover member 28 that cooperate with lateral guide tabs 40 on the base member 8. The cover member is longitudinally horizontally displaced by operation of the screw driver 50 from the first end position adjacent the end of the base member 8 toward an intermediate position shown in FIG. 4.

During this initial displacement of a cover member 28 toward the right, the cooperation between the inclined surfaces on the wedge members 32 carried by the cover member with the inclined surfaces on the wedge members 34 carried by the actuator plate 27 causes the actuator plate to be displaced downwardly toward the base member 8. The wedge surfaces between the first wedge members 32 and 34 have a common wedge angle $\alpha$ as shown in FIG. 5*b*. The cable 2 is supported by the cable support plate 22 at a position just above the knife edges 10 and 11 of the insulation-piercing contacts 9. The base member 8 contains chambers 15 in which are mounted the spring-biased contacts 14 that are electrically connected with the insulation-piercing contacts 9, respectively. The tap-off branch conductors 17 are connected at one end with the spring contacts 14 via openings 16 contained in the bottom portion of the base plate 8.

Figure 6A:
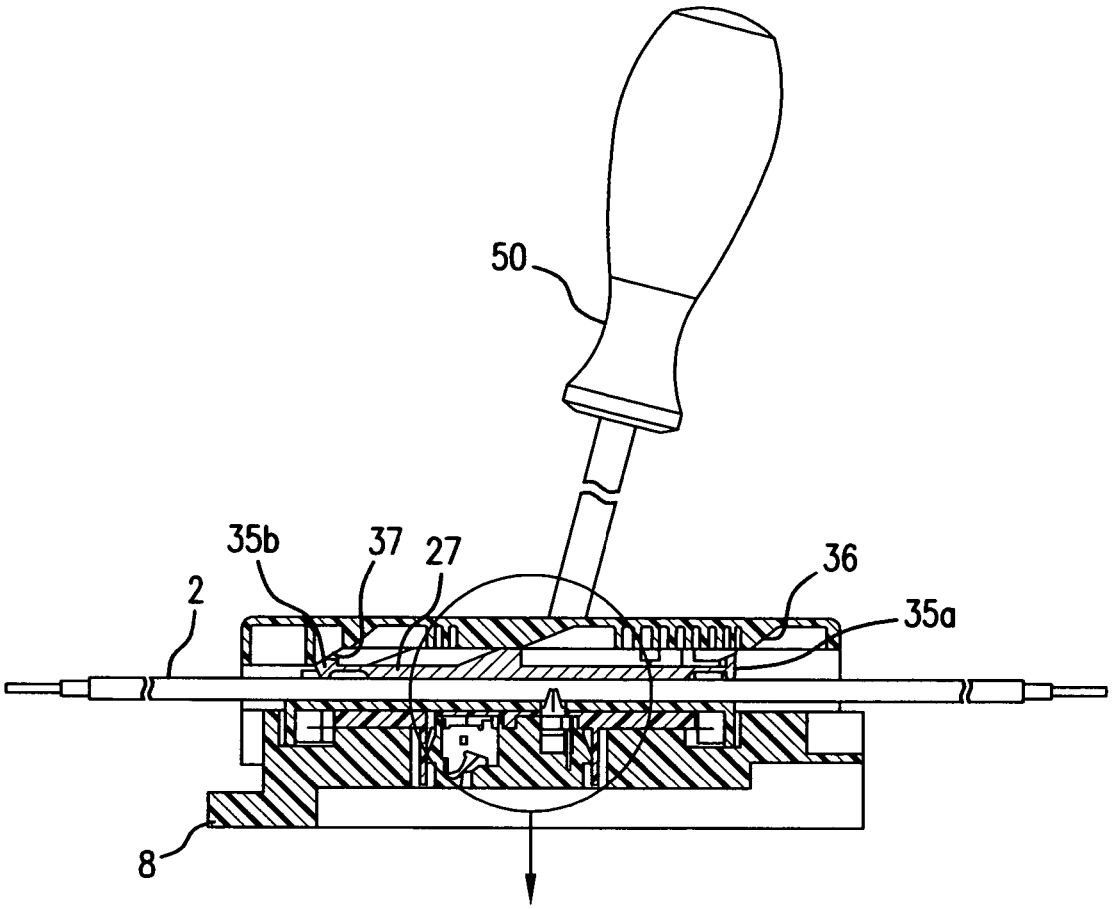
Figure 6B:
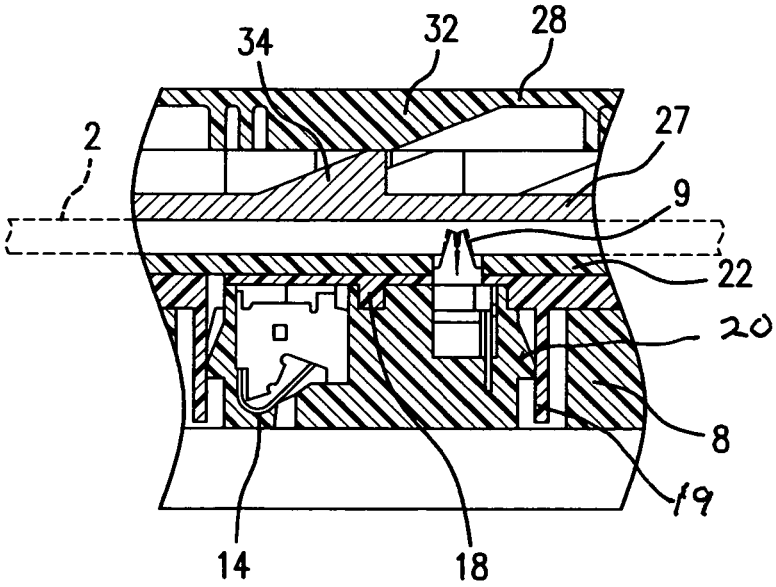

As the cover member 28 is slidably displaced to the right relative to the base member 8 toward the intermediate position of FIG. 6*a*, the cooperation between the wedge members 32 and 34 cause the actuator plate 27, the cable 2 and the cable support plate to be displaced downwardly, thereby to cause the knife edges 10, 11 on the contacts 9 to pierce the outer cable sheath 4 and the insulation layers 3*a* of the corresponding conductors on the flat cable 2. The contacts 9 are now electrically connected between the cable conductors 3 and the respective tap-off branch conductors 17. The catch feet 24*a* engage the recesses 25, thereby to lock the cable support plate to the base member.

Figure 7C:
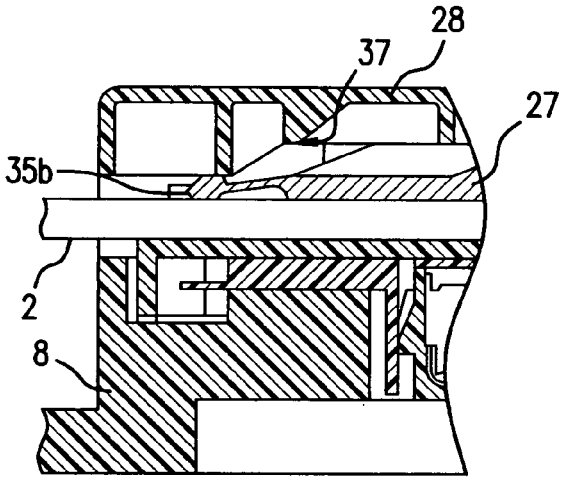
Figure 7A:
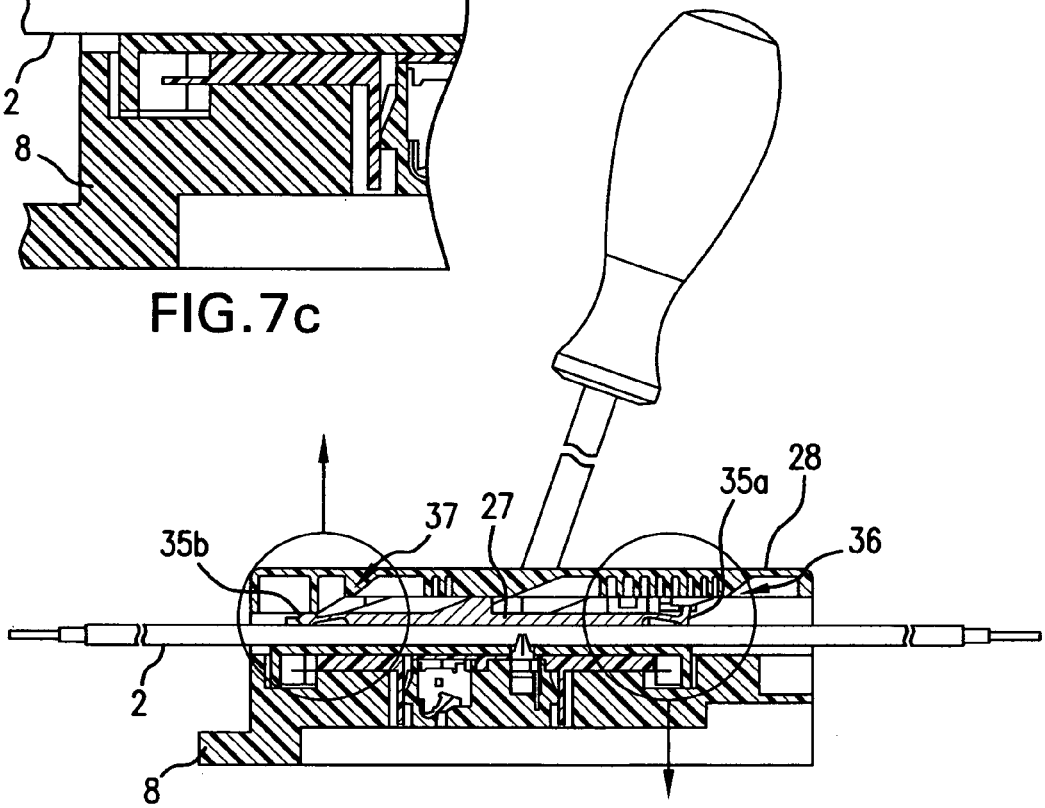
Figure 7B:
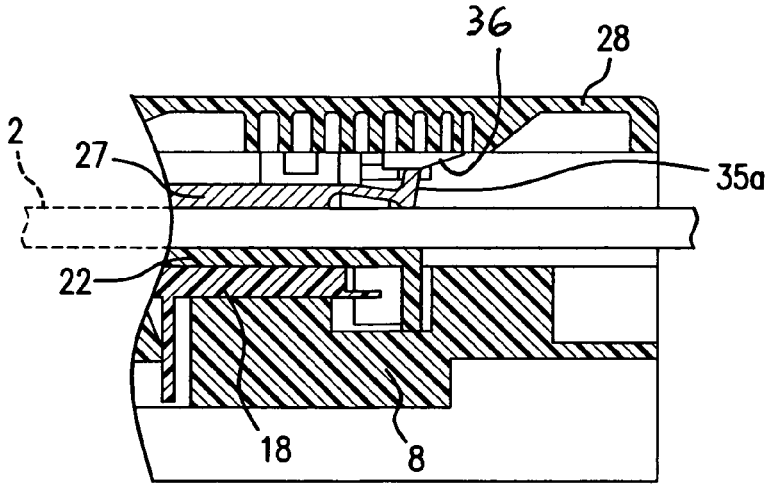

According to another feature of the invention, during further pivotal movement of the screw driver 50 toward the right relative to the base member 8, the cover member 28 is displaced from the intermediate position to its final position (FIG. 7*a*) relative to the base member 8, thereby to cause second wedge means to displace the end portions 35*a* and 35*b* downwardly toward tight clamped positions relative to the flat cable 2. These second wedge means include a cover wedge member 36 at one end of the cover member that engages the flexible end portion 35*a* of the actuator plate 27, and a further cover wedge member 37 at the other end of the cover member 28 which engages a flexible portion 35*b* at the other end of the actuator plate 27. By clamping the end portions 35*a* and 35*b* of the actuator plate 27 to the adjacent surfaces of the flat cable 2, strain relief protection is provided that relieves the strain on the contacts 9 relative to the flat cable 2.

Figure 8:
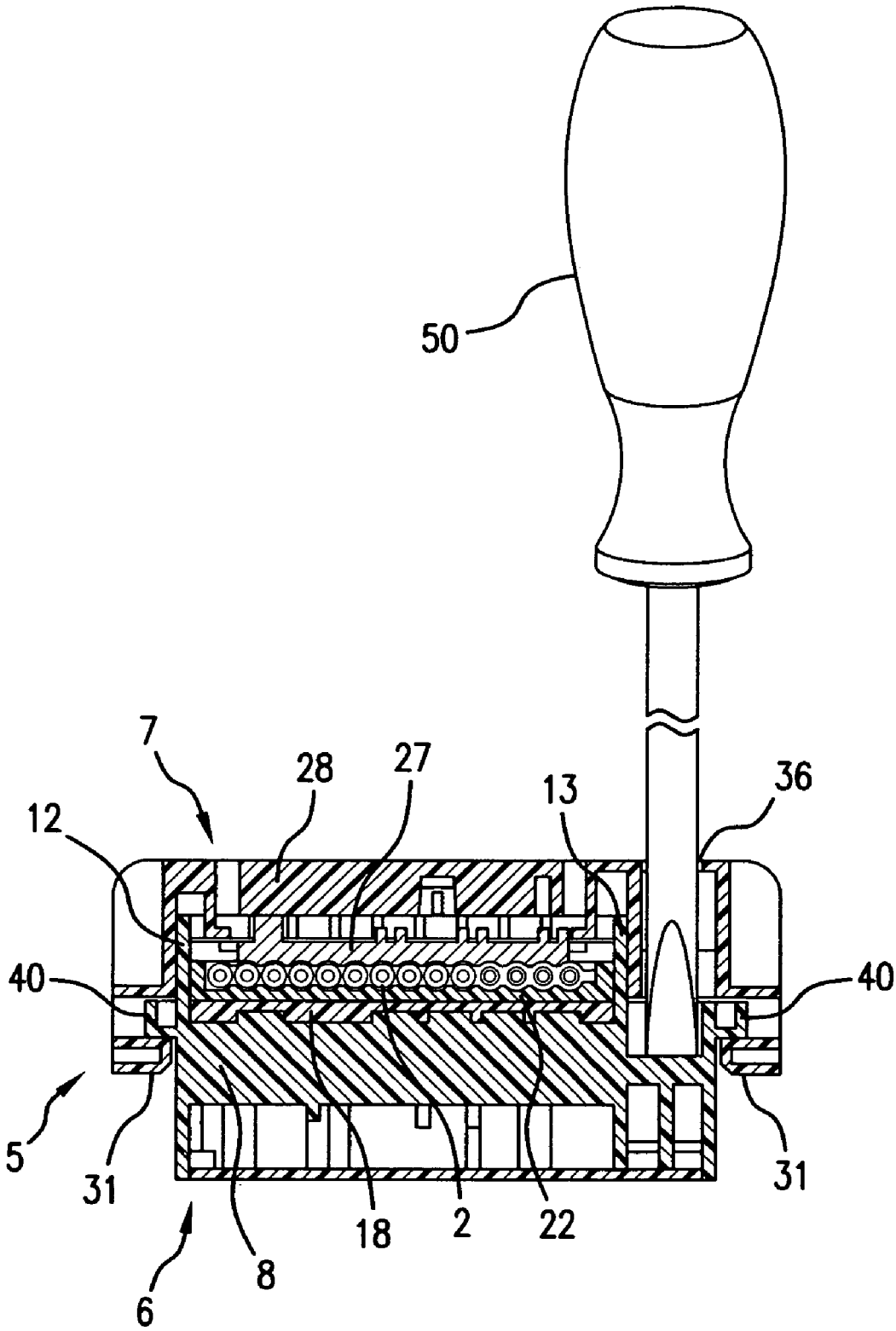
FIG. 8 is a transverse sectional view of the connector arrangement.

As shown in FIG. 8, the cover member 28 serves to maintain the actuator plate 27 in the downwardly displaced position relative to the flat cable 2, thereby to cause the contacts 9 to penetrate the outer casing 4 and the insulation layers of the conductors.

Figure 9A:
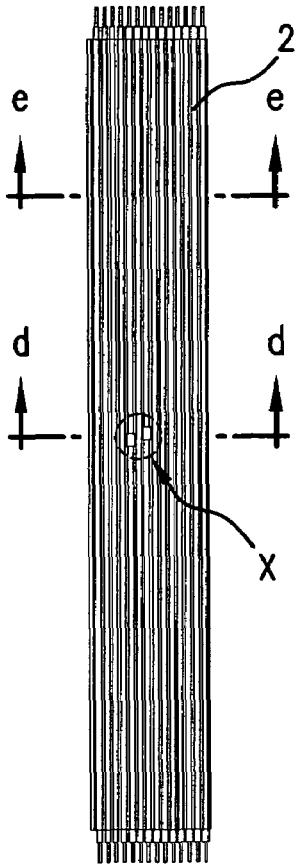
FIG. 9*a* is a plan view of one of the flat conductors used in connection with the invention; 9*b* is an enlarged detailed view of the portion X of the flat conductor of FIG. 9*a*.
Figure 9B:
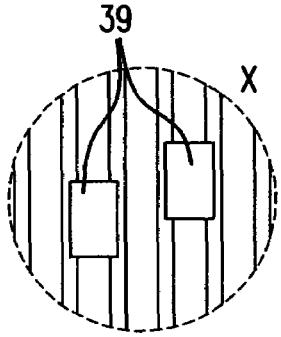
FIG. 9*c* is and end view of the flat conductor of FIG. 9*a*.
FIGS. 9*d* and 9*e* are sectional views taken along lines d-d and e-e of FIG. 9*a;*
Figure 9C:
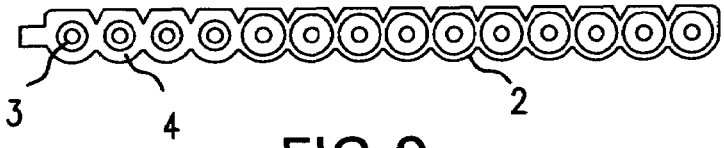
Figure 9D:
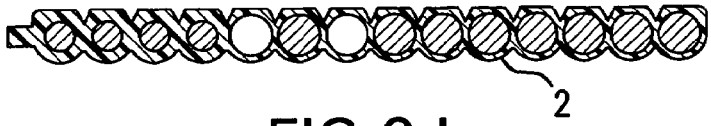
Figure 9E:
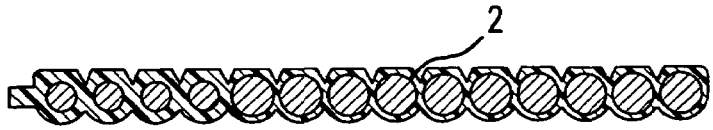
Figure 10A:
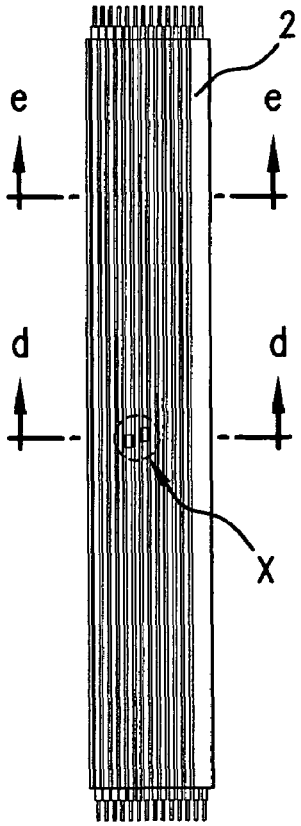
FIG. 10*a* is a plan view of a second flat cable embodiment.
Figure 10F:
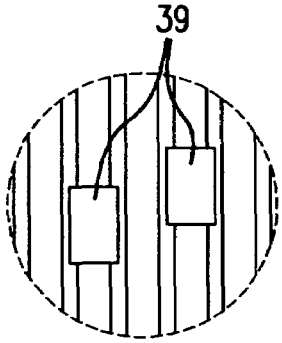
FIG. 10*b* is a corresponding view with certain parts broken away.
FIG. 10*c* is an end view of the flat cable of FIG. 10*a*.
FIGS. 10*d* and 10*e* are sectional views taken along lines d-d and e-e, respectively, of FIG. 10*a*; and 10*f* is a detained view of the circled portion X of FIG. 10*a;*
Figure 10B:
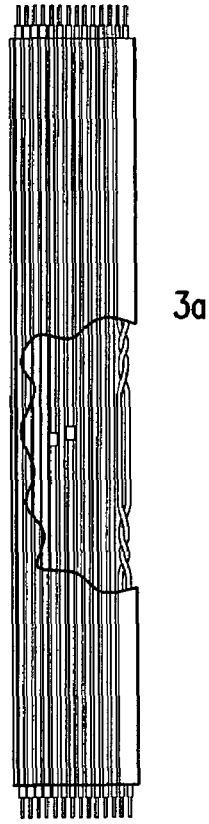
Figure 10C:
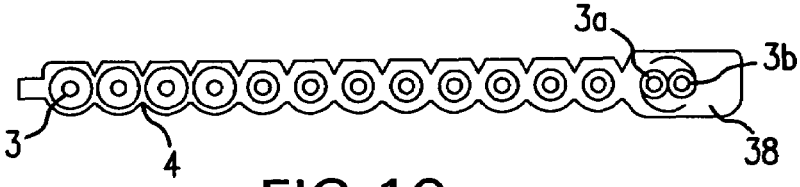
Figure 10D:
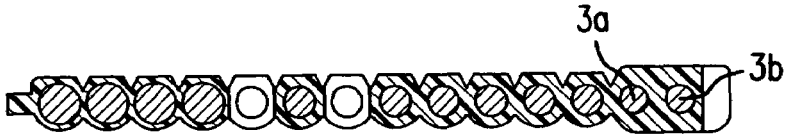
Figure 10E:
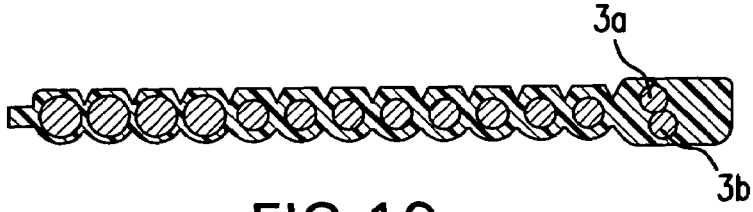

Referring now to FIG. 9*a*, a typical flat cable 2 may be provided with segmented severed portions 39, thereby to define in those conductors end portions that may be connected by the contacts 9 with associated electrical apparatus (not shown). Furthermore, as shown in FIG. 10, the outermost conductors 3*a* and 3*b* may be twisted together, thereby to define on the flat cable an enlarged widened coding area 38.

The cover member 28 and the actuator plate 27 are formed from metal or a hard synthetic plastic material. The clamping end portions of the actuator plate are preferably flexibly connected with the main body portion of the actuator plate. The support member 22, the stabilizing plate 18 and the base member 8 are formed from a suitable electrically insulating synthetic plastic material.

Figure 11A:
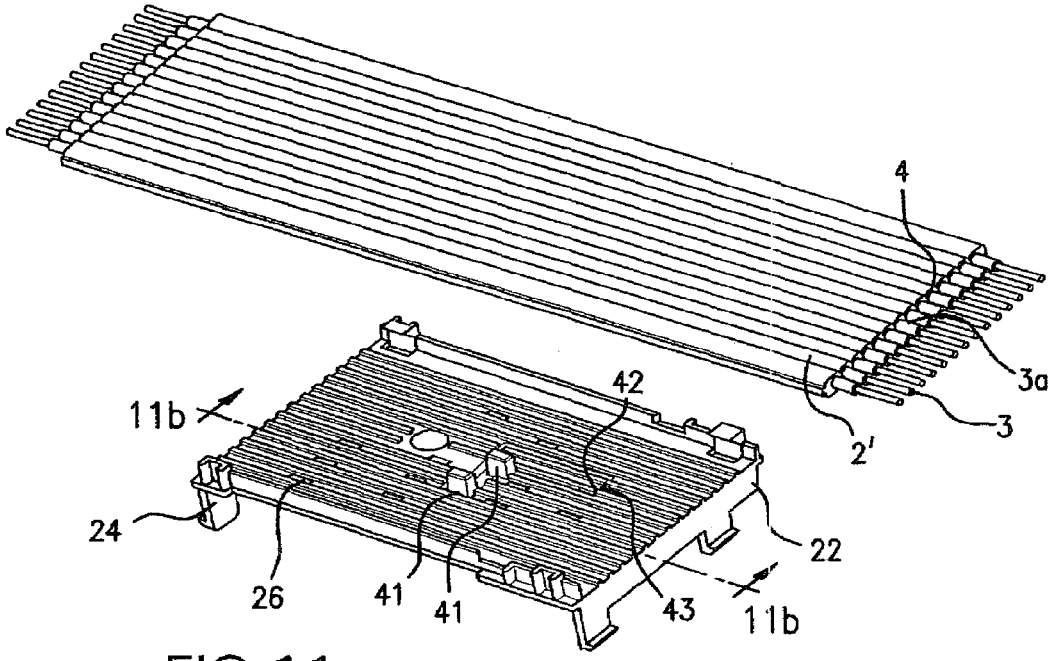
FIG. 11*a* is a detailed perspective view of a first embodiment of the present invention when in the disengaged condition.

Referring now to FIGS. 1 and 11*a*, the horizontal cable support member 22 is provided on its upper surface with at least one upwardly projecting integral locator lug 41 that is adapted to extend with a corresponding access opening 39 contained in the flat cable 2. As is known in the art, this opening 39 extends between the severed ends of an intermediate portion of a desired insulated conductor, thereby to permit the connection of an electrical component to the conductor by a pair of the contacts 9 on opposite sides of the opening. The locator lug 41 is made of insulating material and prevents a short circuit between the adjacent ends of the conductor. The locator lug also serves to locate the longitudinal position of the flat cable relative to the base member 8 and the insulation-piercing contacts supported thereby.

Figure 11B:
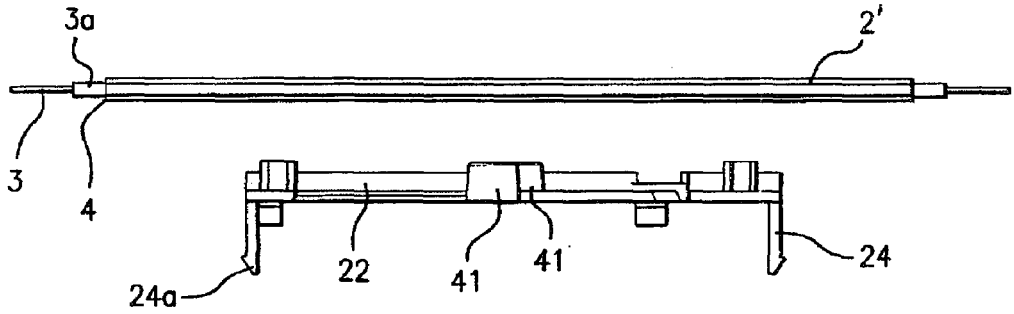
FIG. 11*b* is a sectional view taken along line 11*b*-11*b* of FIG. 11*a;*
Figure 12A:
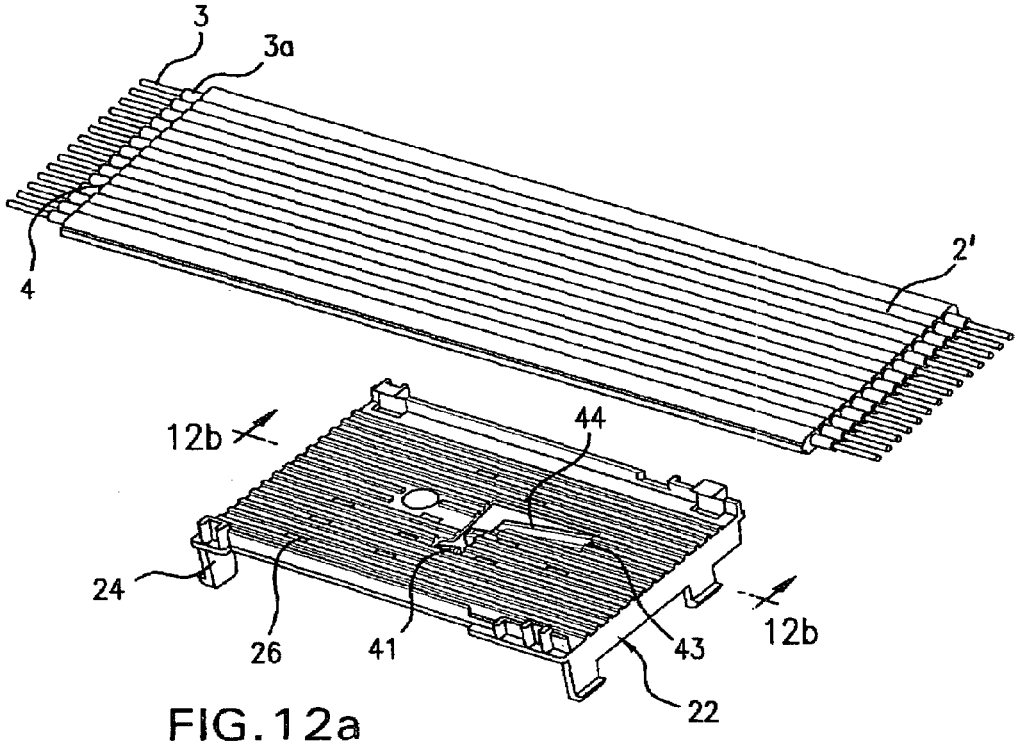
FIG. 12*a* is a detailed perspective view of the apparatus of FIG. 11*a* when in the engaged condition.
Figure 12B:
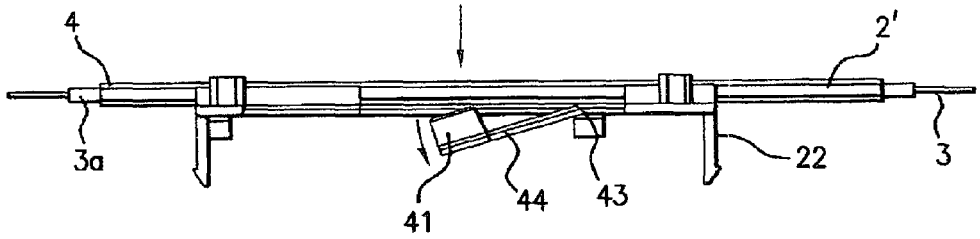
FIG. 12*b* is a sectional view taken along line 12*b*-12*b* of FIG. 12*a;*
Figure 13A:
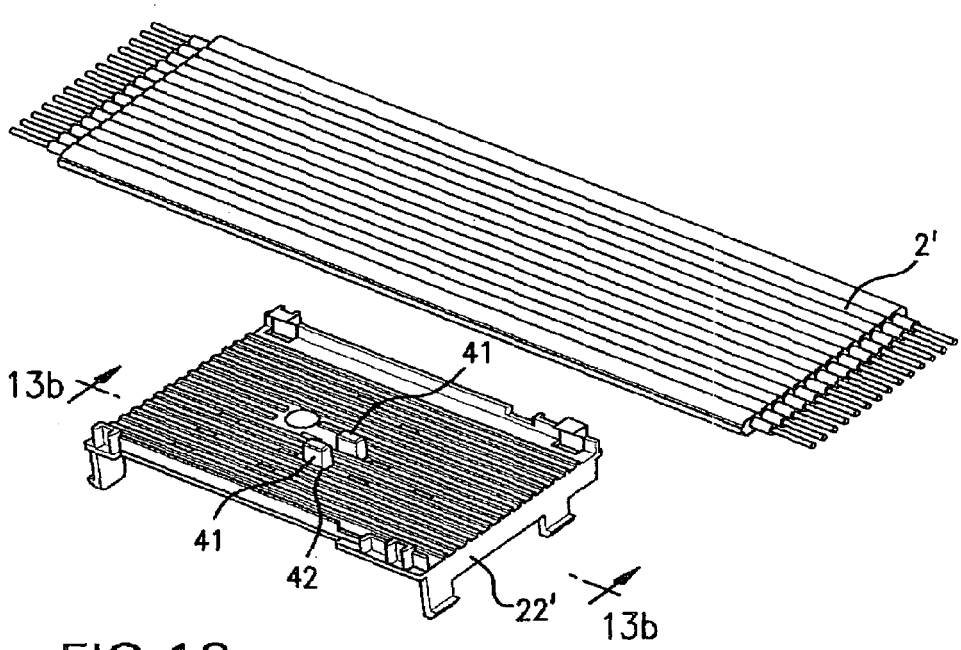
FIG. 13*a* is a detailed perspective view of a second embodiment of the present invention when in the disengaged condition.
Figure 13B:
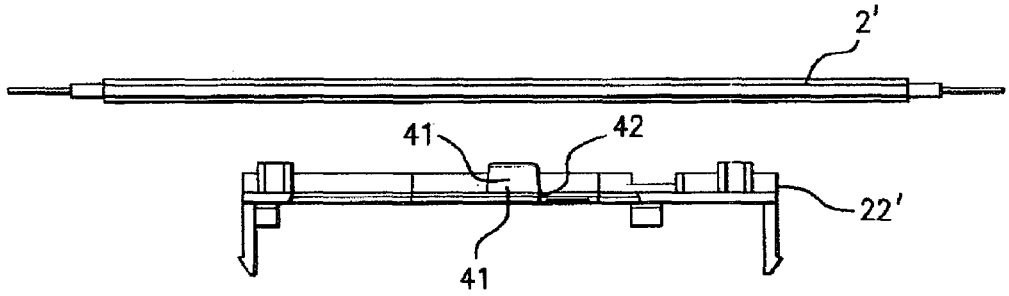
FIG. 13*b* is a sectional view taken along the lines 13*b*-13*b* of FIG. 13*a*.

According to a characterizing feature of the present invention, the locator lug is designed for displacement toward an inoperative position relative to the cable support member 22 in the event that the flat cable 2' (FIG. 11*a*) is uniform and continuous and does not contain an access opening, so that the lug will not interfere with the connection of the insulation-piercing contacts 9 and the insulated conductors 3 contained within cable sheath 4. To this end, a generally U-shaped line of fracture 42 contained in the upper surface of the cable support plate 22 defines an integral flap portion 44 having an end portion upon which is mounted a pair of upwardly projecting locator lugs 41. At its other end, the flap 44 is pliable and is connected with the cable support plate 22 for bending movement about a bending or pivot axis 43, as shown in FIG. 12*b*. Thus, when the flat uniform cable 2' in the upper position of FIG. 11*b* is displaced downwardly by the actuator plate 27 of FIG. 1 toward the support plate 22, the lower surface of the flat cable engages the upper extremity of the locator lug 41, the fracture line 42 is ruptured and the flap 44 is bent downwardly toward the inoperative position of FIG. 12*b*. Owing to the first wedge means 30, further horizontal displacement of the actuator plate 27 toward its final second position causes cable 2' and support plate 22 to be displaced downwardly relative to the base member 8, whereupon the contacts will project upwardly through the slits 26 for insulation-piercing engagement with the associated conductors. It will be apparent that in this embodiment, the line of fracture 42 could be a line of complete cut, if desired.

Figure 14A:
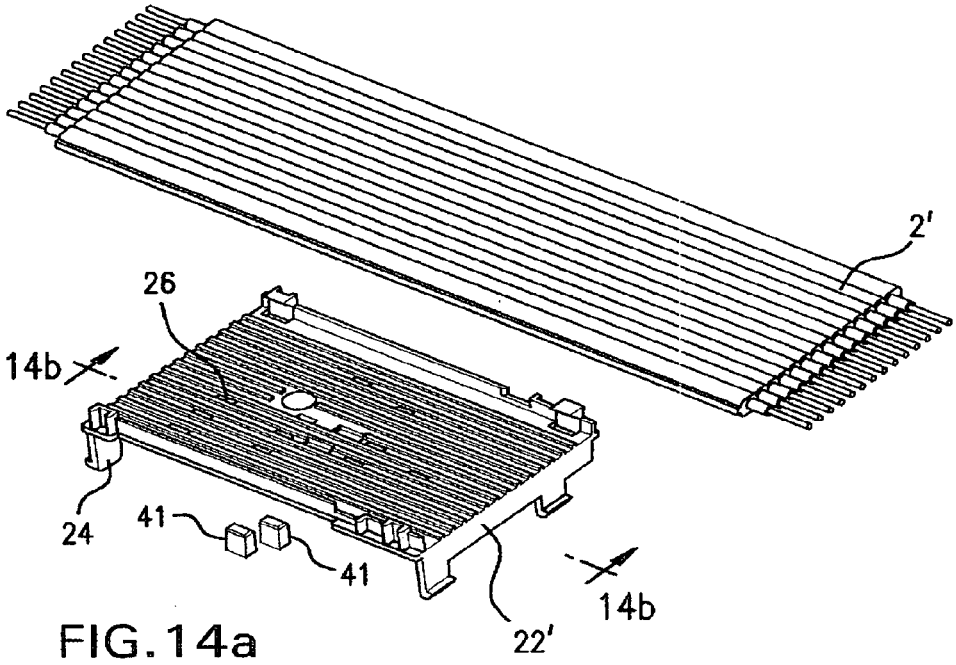
FIG. 14*a* is an exploded view of the apparatus of FIG. 13*a* when in the engaged condition.
Figure 14B:
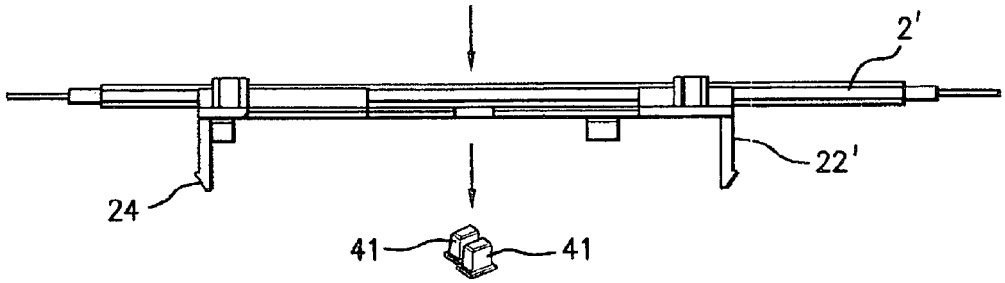
FIG. 14*b* is a sectional view taken along line 14*b*-14*b* of FIG. 14*a*.

In a second embodiment shown in FIGS. 13*a*-14*b*, each locator lug 41 is connected with the cable support plate 22' by a line of fracture 42' such that when the upper extremity of a lug is engaged by the continuous lower surface of a uniform cable 2', the line of fracture is broken, and the lug is complexly displace from the cable support plate 22', as shown in FIGS. 14*a* and 14*b*. Therefore, the lug does not interfere with the mounting of the cable 2' on the upper surface of the cable support member, as shown in FIG. 14*b*.

According to a third embodiment, the lug is formed of a compressible synthetic plastic material that is normally resiliently biased to its extended condition, said lug be compressed and deformed toward an inoperative condition, whereby the lug will not interfere with the operation of the insulation-piercing contacts. Furthermore, the lugs could be positioned on springs so that during assembly, they are deformed out of the plane of the uniform flat cable that does not contain any access opening.

Although the invention has been disclosed in connection with a connector arrangement including wedge means for displacing an actuator plate toward a cable support plate in order to effect penetration of the conductor insulation layers by the electrical contacts, it will be apparent that the invention could be used with various other types of connectors, such as those used with elevator cables, including cover members that are threadably connected with a base member.

While in accordance with the provisions of the Patent Statutes the preferred forms and embodiments of the invention have been illustrated and described, it will be apparent to those skilled in the art that changes may be made without deviating from the invention described above.

What is claimed is:

1. A flat cable connector arrangement for connecting an insulated conductor (3) of a flat multi-conductor cable (2, 2') having an outer cable sheath (4) with an electrical load, comprising:

(a) housing means including a base member (8) and a cover member (7) that cooperate to define a through passage for receiving a linear intermediate portion of the flat cable;

(b) a plurality of insulation-piercing electrical contacts (9) mounted within said housing, each of said contacts being operable to pierce the cable sheath and the insulation layer (3*a*) of at least one of said conductors, thereby to electrically engage the conductor;

(c) at least one locator lug (41) formed from an electrically-insulating synthetic plastic material; and (d) mounting means normally supporting said locator lug within said housing through passage at an operable first position for entry within an access opening contained in the intermediate portion of said cable (2) and that extends between the adjacent ends of a conductor separated by the opening, said locator lug being operable during the assembly of the connector with a uniform cable (2') that does not contain an access opening toward an inoperable second condition out of the plane defined by the adjacent surface of the cable intermediate portion.

2. A flat cable connector arrangement as defined in claim 1, wherein said mounting means is such that when said locator lug is engaged by a uniform cable (2') that does not contain an access opening, said locator lug is displaced by the uniform cable away from said operable first position toward said second inoperable condition.

3. A flat cable connector arrangement as defined in claim 2, wherein said mounting means includes frangible support means (42) such that when said locator lug in said operable first position is engaged by a uniform cable (2') that does not contain an access opening, said frangible support means is ruptured and said locator lug is displaced toward said second condition.

4. A flat cable connector arrangement as defined in claim 3, wherein said locator lug is completely broken away from said mounting means when said frangible support means is ruptured.

5. A flat cable connector arrangement as defined in claim 3, wherein said mounting means includes a cable support plate (22) formed of a pliable synthetic plastic material, said frangible support means (42) being generally U-shaped to define in said cable support plate a flap (44) that carries said locator lug, said flap being bendable about a pivot axis (43), whereby when said locator lug is engaged by a uniform cable (2'), said frangible support means is ruptures and said flap is bent about said pivot axis to displace said locator lug toward said inoperable second position.

6. A flat cable connector arrangement as defined in claim 2, and further including resilient means biasing said locator lug toward said operable first position.

7. A flat cable connector arrangement as defined in claim 1, wherein said locator lug is formed from an elastic resilient material such that when said locator lug is engaged by a uniform cable (2') that does not contain an access opening, said locator lug is deformed away from the plane containing the adjacent surface of the flat cable toward said second condition.

8. A flat cable connector arrangement as defined in claim 1, wherein said housing cover member is connected for longitudinal sliding displacement relative to said housing base member; and further including;

(e) wedge means (30) responsive to the longitudinal displacement of said cover member relative to said base member for displacing the flat cable toward electrical engagement with said insulation-piercing electrical contacts.

9. A flat cable connector arrangement as defined in claim 1, and further including:

(e) a cable support plate (22) arranged in said housing through passage, said locator lug being carried by said support plate.

10. A flat cable connector arrangement as defined in claim 9, wherein said locator lug is connected for movement relative to said cable support plate.

11. A flat cable connector arrangement as defined in claim 9, and further including catch means (24*a*, 25) for locking said cable support plate to said housing means.

12. A flat cable connector arrangement as defined in claim 9, wherein said cable support plate is arranged between said electrical contacts and the flat cable, said cable support plate containing slits (26) opposite said insulation-piercing electrical contacts, respectively, said contacts extending through said slits during the insulation-piercing operation of said contacts toward engagement with the conductors.

13. A flat cable connector arrangement as defined in claim 12, wherein contacts are mounted on said housing base member; and further wherein said cable support plate is connected with said housing base member for displacement between a first position spaced from said contacts and a second position receiving said contacts, respectively.

14. A flat cable connector arrangement as defined in claim 13, wherein said cover member is connected for sliding longitudinal movement relative to said base member, said cover member including actuating means (27) for displacing said cable support member from said first position toward said second position.

15. A flat cable connector arrangement as defined in claim 14, and further including guide means (31, 40) guiding said cover member for sliding displacement relative to said base member.

16. A flat cable connector arrangement as defined in claim 15, wherein said actuating means includes an actuating plate arranged between said cover member and the cable, said actuator member being connected for displacement in a direction normal to said base member.

17. A flat cable connector arrangement for connecting an insulated conductor (3) of a flat multi-conductor cable (2) with a tapped-off branch conductor (17), comprising:

(a) housing means (6) including a generally rectangular base member (8) having a longitudinal axis and a horizontal upper surface;

(b) a plurality of insulation-piercing electrical contacts (9) carried by said base member upper surface and extending upwardly therefrom, the upper extremities of said contacts having knife edges (10, 11);

(c) cable support means (22) for supporting the flat cable horizontally for vertical displacement above said base means with the conductors of the cable positioned above said contacts, respectively, said cable support means containing openings (26) opposite said contacts, respectively;

(d) a horizontal actuator plate (27) connected with said base member above said cable support means and a cable supported thereon for displacement between an upper position spaced above said contacts toward a lower position adjacent said contacts;

(e) displacing means for displacing said actuator plate downwardly to press the cable conductors into insulation-piercing engagement with the associated respective contacts, including:

(1) a housing cover member (28) arranged horizontally above and spaced from said actuator plate;

(2) engaging means (31, 40) connecting said cover member with said base member for horizontal longitudinal sliding displacement relative to said base member between a first position partially displaced from said base member and a second position over said base member;

(3) first wedge means (30) arranged between said actuator plate and said cover member, said first wedge means being operable by said actuator plate during the initial displacement of said cover member from said first position toward said second position to displace the cable and the cable support member downwardly, thereby to effect insulation-piercing engagement between said contact knife edges and the associated conductors; and (f) electrical connecting means (14) for connecting an electrical load with said electrical contacts, respectively;

(g) said cable support means including:

(1) a horizontal cable support plate (22) having an upper surface adapted to support the flat cable, said support plate being formed from an electrically insulating synthetic plastic material;

(2) means (24) connecting said support plate for vertical displacement between upper and lower positions relative to said base means;

(3) at least one locator lug (41) integral with and extending upwardly from said cable support plate, whereby when the lower surface of the cable contains an access opening (39) extending upwardly between a separated intermediate portion of one of the insulated conductors of the cable and when said cover member is displaced from said first position toward said second position, said lug will extend into said opening between said separated conductor portions; and (4) means operable when the lower surface of the cable is uniform, continuous and uninterrupted for producing downward displacement of said lug relative to said support plate, whereby said positioning lug will not interfere with the piercing by the electrical contacts of the outer sheath layer of the cable and the insulation layer of the associated conductor.

18. A flat cable connector arrangement as defined in claim 17, wherein said cable support plate is formed from a pliable material, said cable support place containing at least one line of fracture (42) defining an integral flap portion (44) having a first end connected with said cable support plate for bending movement about a given pivot axis (43), said flap portion having a second end that carries and is integral with said locator lug, said flap portion being pivoted downwardly about said pivot axis relative to said cable support plate by the engagement between the cable lower surface and said locator lug when said cover member is displaced from said first position toward said second position.

19. A flat cable connector arrangement as defined in claim 17, wherein said cable support plate contains at least one line of fracture (42') that is ruptured when said cover member is displaced from said first position toward said second position, thereby to effect complete downward separation of said lug from said cable support plate.

20. A flat cable connector arrangement as defined in claim 17, wherein said locator lug is formed from a vertically-compressible resilient synthetic plastic insulating material such that when said cover member is displaced from said first position toward said second position, said lug is compressed to permit the associated ones of said electrical contacts to pierce the outer sheath layer of the cable and the insulation layer of the associated conductor.

* * * * *